United States Patent [19]

Carbonnel

[11] Patent Number: 4,586,698

[45] Date of Patent: May 6, 1986

[54] LATERAL BASIN FOR ELECTROMAGNETIC PUMPING IN A FOUNDRY

[76] Inventor: Henri Carbonnel, 11 avenue Beauséjour, 92160 Anthony, France

[21] Appl. No.: 703,564

[22] Filed: Feb. 20, 1985

[30] Foreign Application Priority Data

Feb. 20, 1984 [FR] France ..... 84 02492

[51] Int. Cl.[4] ..... F27D 3/14

[52] U.S. Cl. ..... 266/237

[58] Field of Search ..... 266/234, 237; 417/50

[56] References Cited

U.S. PATENT DOCUMENTS 3,591,698 7/1971 Howard et al. ..... 266/234

3,844,453 10/1974 Eickelberg ..... 266/234

*Primary Examiner*—Melvyn J. Andrews

*Attorney, Agent, or Firm*—Sughrue, Mion, Zinn, Macpeak, and Seas

[57] ABSTRACT

The invention relates to a lateral basin for electromagnetic pumping in a foundry and in particular in a light metal foundry. The pump comprises a magnetic circuit (207) which is locally saturated and which is embedded in the ceramic of the said basin. The electrical excitation winding of the magnetic circuit (208) is located outside the basin, and the circuit is disposed to create a horizontal leakage field through an active portion (204) of a liquid metal turn which, together with electrical current induced in said active portion (204), sets up a magnetic pumping force which is upwardly directed and which urges liquid metal into a duct (206) leading away from the furnace to liquid metal receiving means. The liquid from the furnace (202) supplies the active portion of the liquid metal turn (204) via a passage (205) of height limited by a partition (209). The electromagnetic pumping basin enables almost any casting requirements in a foundry to be supplied with liquid metal.

6 Claims, 14 Drawing Figures

FIG. 9
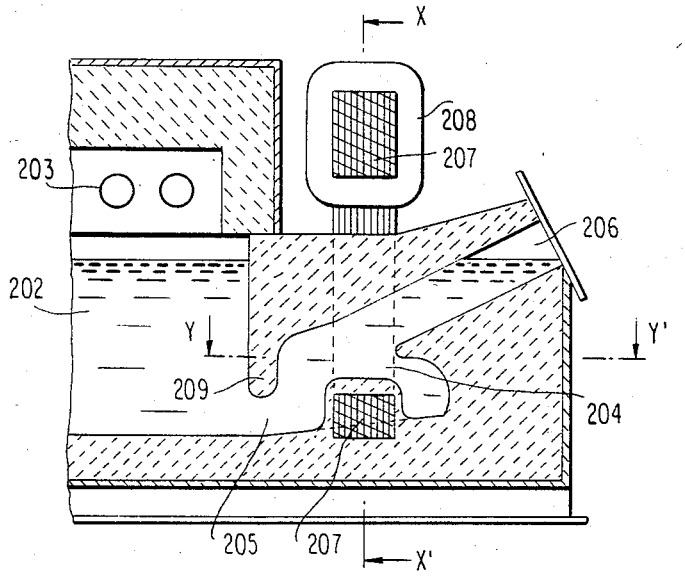
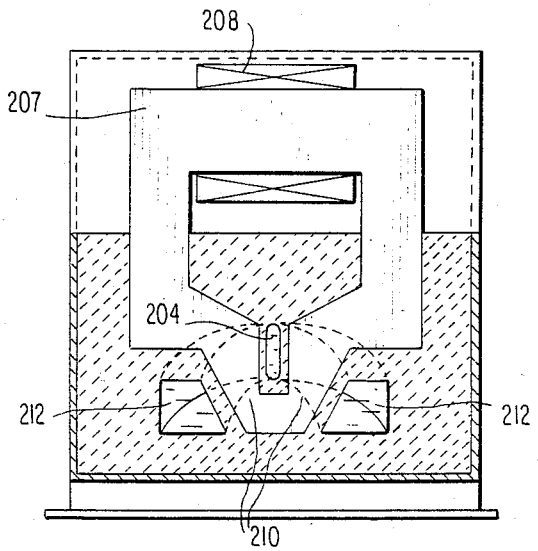
FIG. 10
FIG. 11
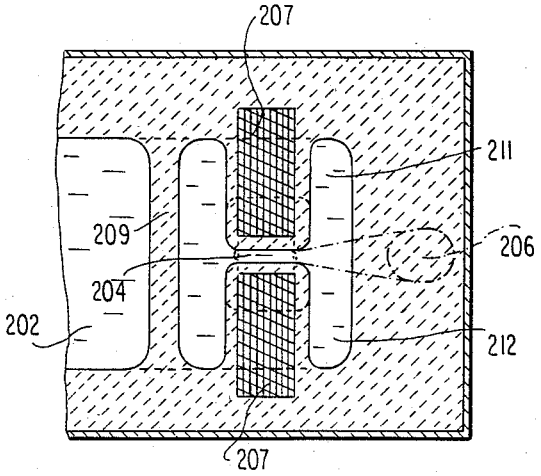

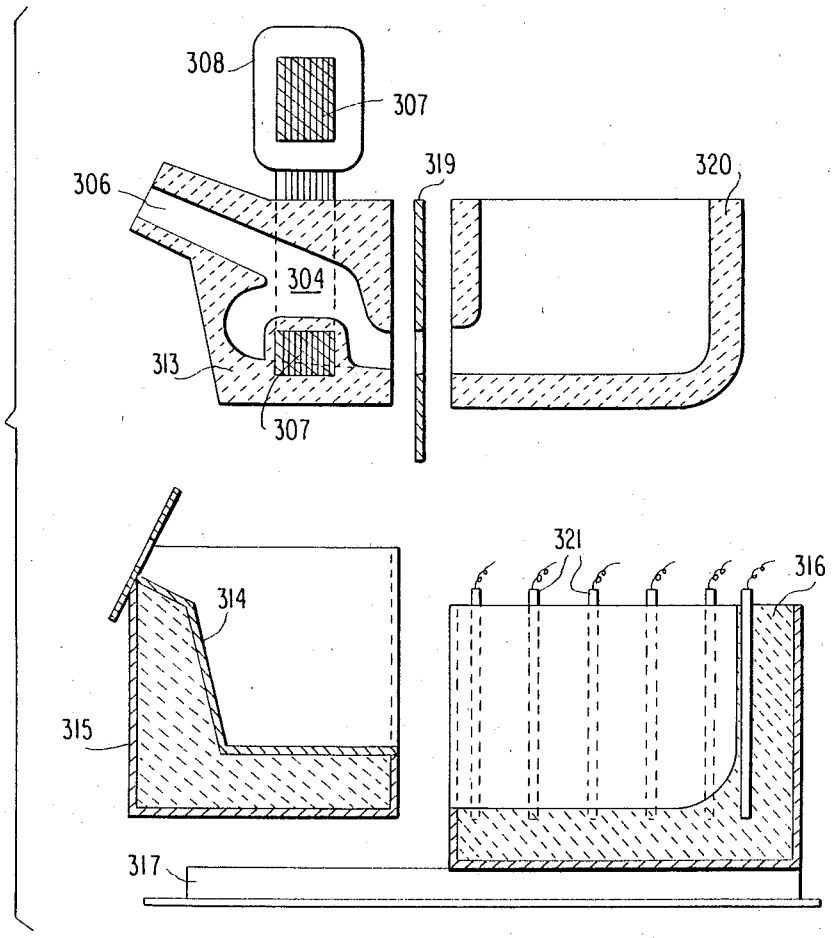
FIG. 14
FIG. 12
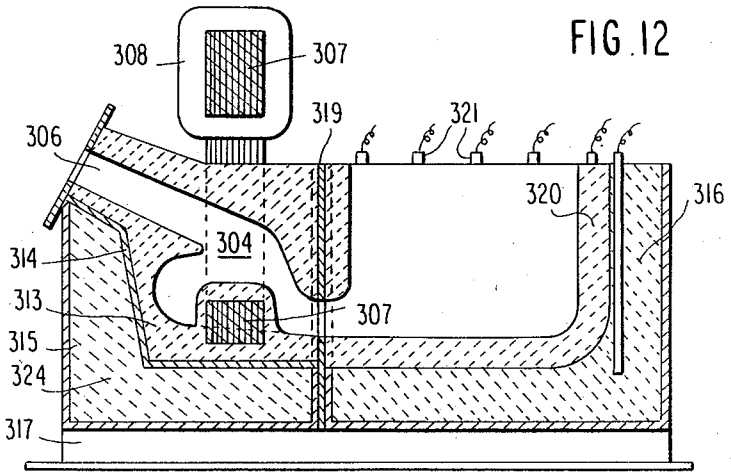
FIG. 13
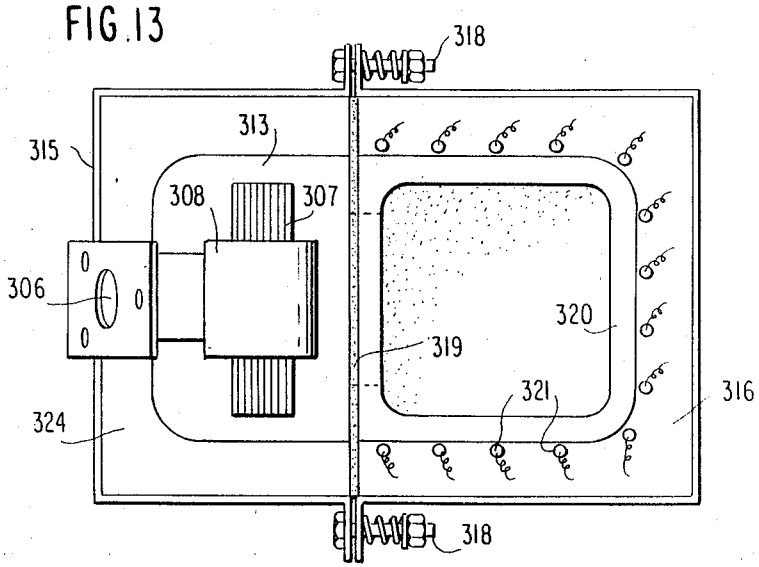

LATERAL BASIN FOR ELECTROMAGNETIC PUMPING IN A FOUNDRY

The present invention relates to a lateral basin for electromagnetic pumping in a foundry to move molten metal purely by means of electromagnetic forces, in order to fill molds in foundries in general, and more particularly in the light metals industry.

BACKGROUND OF THE INVENTION

The use of electromagnetic forces for this purposes is well known and has been described in numerous patents relating to electromagnetic pumps, which patents may be classified into two broad categories.

The first category concerns pumps for liquid sodium and is mostly concerned with fast neutron nuclear reactors. Most of the electromagnetic pump patents which we have come across worldwide relate to this type of pump. The earliest patents of which we are aware date from the beginning of this century and the first pump was constructed by Hartman in 1918. The main patents are in the names of Albert Einstein and Léo Szélard and were originally filed in Berlin in the 30s (e.g. German patent No. 555.413 Class 17a group 304 and patent No. 476.812 Class 31c group 26). The sodium is kept out of contact with the air in ducting which is generally made of low carbon stainless steel, and the active portion of the pump is constructed around the ducting such that the magnetic portion and the electrical windings are themselves in air.

These "sodium" pumps are mentioned here by way of background since their construction and use are very different from those of the present application, although the same physical principles are used to cause the metal to move, which means, inter alia, that a pump in accordance with the present invention is perfectly capable of being used for pumping liquid sodium.

The second category of electromagnetic pump is used industrially for moving molten metals other than sodium. Such pumps are used in foundry technology rather than in nuclear reactor technology. Generally speaking, the electromagnetic pumps used in foundries operate on one of the following three principles:

(1) Pumps operating on Lenz's law;
(2) Submerged pumps; and
(3) Pumping systems which are mounted directly on a furnace but which are outside the furnace.

A common drawback with all of these pumps is that they cause molten metal to flow through ducting which is external to the furnace in which the metal is melted. As a result, there is a high risk of the electrical portions and any surrounding equipment of the pump being destroyed in the event of accidental leakage of molten metal.

Preferred embodiments of the present invention reduce the danger of the pump being damaged by the liquid metal.

SUMMARY OF THE INVENTION

The present invention consists in integrating the magnetic components and the liquid turn of an electromagnetic pump in the heat-proofing ceramic of a lateral basin in a furnace, with the electrical windings required to operate the pump being located externally to the basin.

There is thus no danger from possible leakage of molten metal since it is the ceramic heat-proofing of the furnace which surrounds the magnetic circuits and which thus protects them from the liquid metal (which is highly corrosive at such temperatures). The ceramic lining is generally contained in a metal tank which is usually itself liquid-proof. The purpose of this tank is also to provide mechanical strength for the ceramic parts of the furnace during transport (e.g. in the form of a ladle) or against shocks in situ.

It is thus possible to integrate one or more known electromagnetic pumping systems in such a basin. However, in the intended application, it is advantageous to use a novel pumping system as described below.

BRIEF DESCRIPTION OF THE DRAWINGS

Embodiments of the invention are described by way of example with reference to the accompanying drawings, in which:

FIGS. 9, 10 and 11, are sections similar to FIGS. 2, 3, and 4 respectively showing a furnace with a second lateral basin in accordance with the invention;

FIG. 12 is a side view in section through a furnace having a removable lateral basin in accordance with the invention;

FIG. 13 is a plan view of the FIG. 12 furnace; and

FIG. 14 is an exploded section view of the FIG. 12 furnace.

MORE DETAILED DESCRIPTION

To facilitate understanding the novel pumping system proposed, the various phases through which the invention has passed to arrive at the present solution are described step-by-step, and each step constitutes a possible embodiment of the invention, although it is naturally believed that the final step constitutes the best embodiment in the application currently envisaged. The novel pumping system makes use of a partially saturated magnetic circuit.

Figure 1:
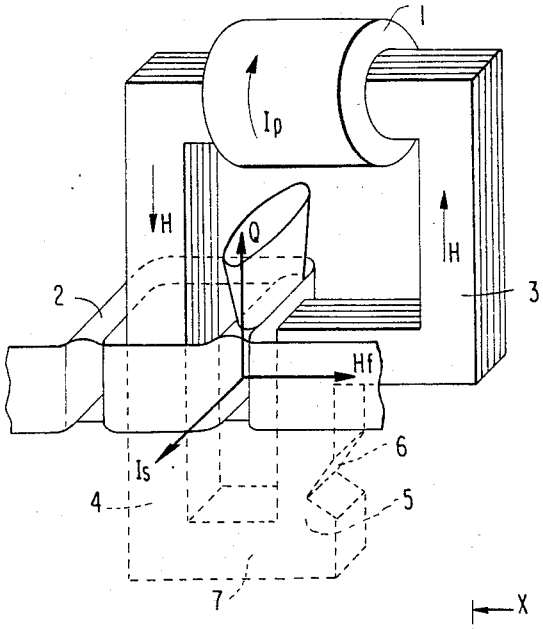
FIG. 1 is a perspective diagram showing the basic principles of an electrodynamic pumping system.

FIG. 1 is a perspective diagram showing the basic principles on which an electromagnetic pump in accordance with the invention operates. The pump is based on a transformer having a primary winding 1 and a secondary winding 2 which is filled with liquid metal and thus constitutes a "liquid turn". The front face of the liquid turn is directly open to the volume of liquid metal in the furnace. The magnetic circuit of the transformer 3 is deformed in its bottom half such that its vertical legs are brought closer to each other than they are in its top half. This may be done by including a horizontal portion in one or both legs. As a result of the lower halves being closer together than the top halves, there is a leakage field in a generally horizontal direction running from the left leg 4 towards the right leg 5 in the transformer as seen in the drawing. This leakage field partially short-circuits the bottom horizontal branch 7 of the magnetic circuit.

The horizontal leakage field can be increased between the two vertical legs where they come closer together by creating local saturation by any of various well-known means, for example by a notch 6 in the right leg 5 as shown in FIG. 1. Other suitable means include vertical or horizontal slots or holes through the magnetic circuits or progressive necking of the vertical legs or of the horizontal branch or even partial replacements of the laminations which are magnetic at the operating temperatures by other laminations which are less magnetic or not magnetic at all at such temperatures, or by any other suitable and well-known means.

The effects of the saturation is to set up a horizontal leakage field Hf just above the narrow point 6 in the magnetic circuit, which horizontal field by-passes the bottom horizontal branch of the magnetic circuit by passing from one leg of the transformer to the other above the point of saturation.

This leakage field Hf in combination with the secondary current Is induced in the liquid turn 2 creates a vertical force Q by application of Ampère's rule.

Figure 2:
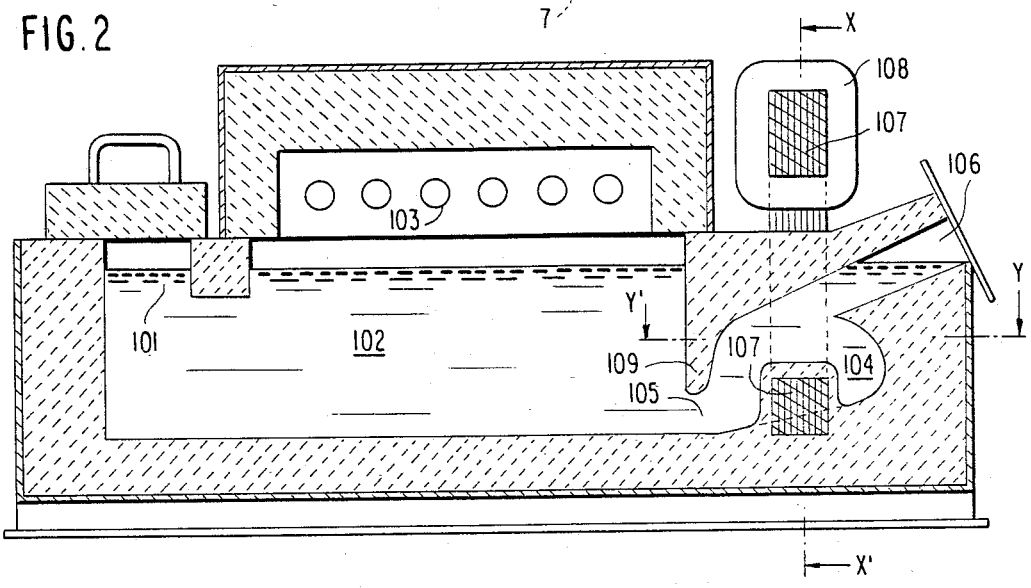
FIGS. 2, 3, and 4, are sections through a furnace incorporating a first lateral basin in accordance with the invention, and are a side view, an end view and a plan view respectively.
Figure 3:
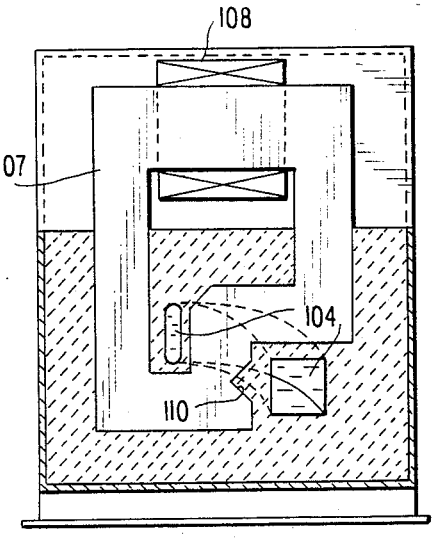
Figure 4:
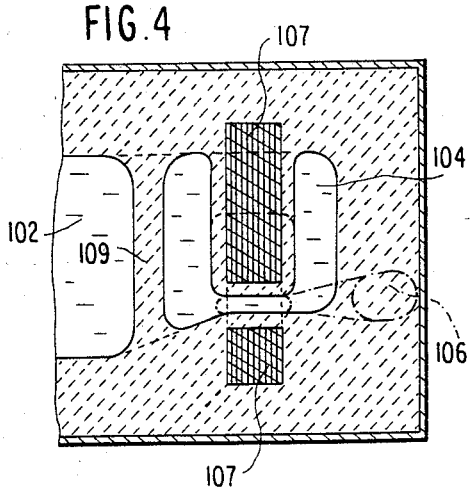

In practice, the electromagnetic pumping system whose theory is outlined above is cast in the ceramic of the lateral basin of a furnace in a foundary as shown in FIGS. 2, 3 and 4.

FIG. 2 is section through a furnace and shows from left to right, a loading basin 101, a melting or holding basin 102 and electrical heater elements 103. Naturally, and without altering the invention, the furnace could be heated by gas or by oil or by an induction system. The electromagnetic pumping system is to the right of the furnace as shown in the drawing in a lateral basin. This basin includes the liquid turn 104 which is in communication with the main furnace via an inlet orifice 105 and which leads to the outside via a duct 106. The magnetic circuit 107 is driven by a winding 108. A ceramic partition 109 separates the front face of the liquid turn 104 from the bulk of the liquid metal in the furnace 102 so as to reduce unwanted flow between the furnace and the electromagnetic pump. Thus, the active turn 104 is above the bottom of the furnace and is sloping towards the bottom of the furnace so as to enable the turn to be emptied.

FIG. 3 is a vertical section on a line XX' through the electromagnetic pumping system, and it can be seen that the inlet to the liquid turn 104 is to the right of the drawing and below the active portion thereof. This figure also shows the magnetic circuit 107 together with its primary excitation winding 108. The saturation notch is referenced 110 in this figure.

FIG. 4 is a horizontal section on a line YY' through the liquid turn 104 showing the magnetic circuit 107, the outlet tube 106, and the ceramic partition 109 which partially separates the liquid turn 104 from the body of the molten metal in the main part of the furnace 102.

The particular magnetically saturated electromagnetic pumping system shown diagrammatically in FIG. 1 is not the only possible configuration for the pumping system. Several variant electromagnetic pumping systems using magnetic saturation and all capable of being incorporated in the ceramic of a furnace lateral basin instead of the FIG. 1 pumping system are now described.

Figure 5:
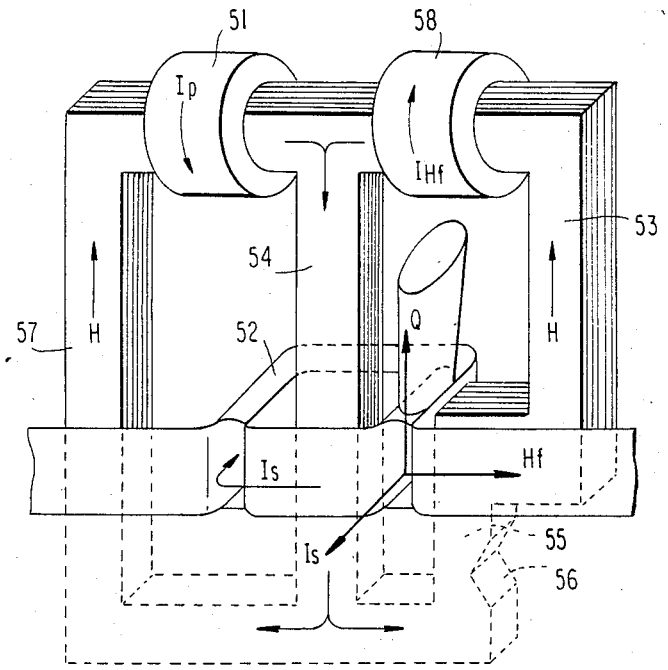
FIGS. 5, 6, 7, and 8 are perspective diagrams similar to FIG. 1 showing four variant electrodynamic pumping systems.

FIG. 5 is a diagram similar to FIG. 1 showing a first variant. In this variant the transformer has three vertical magnetic branches with a middle branch 54 passing through the middle of the liquid turn 52. The electric current in the liquid turn is induced firstly by the circuit comprising the vertical leg 57 and the middle leg 54 and partially by the circuit comprising the other vertical leg 53 and the middle leg 54. In the circuit 53–54, the winding 58 serves to create the leakage field as increased by the saturation notch 56 and extending between the relatively close bottom portions of the legs 54 and 53. The drawing shows two separate windings 51 and 58 on each half of the top horizontal branch of the magnetic circuit. These two windings could be replaced by a single common winding around the middle leg 54.

Figure 6:
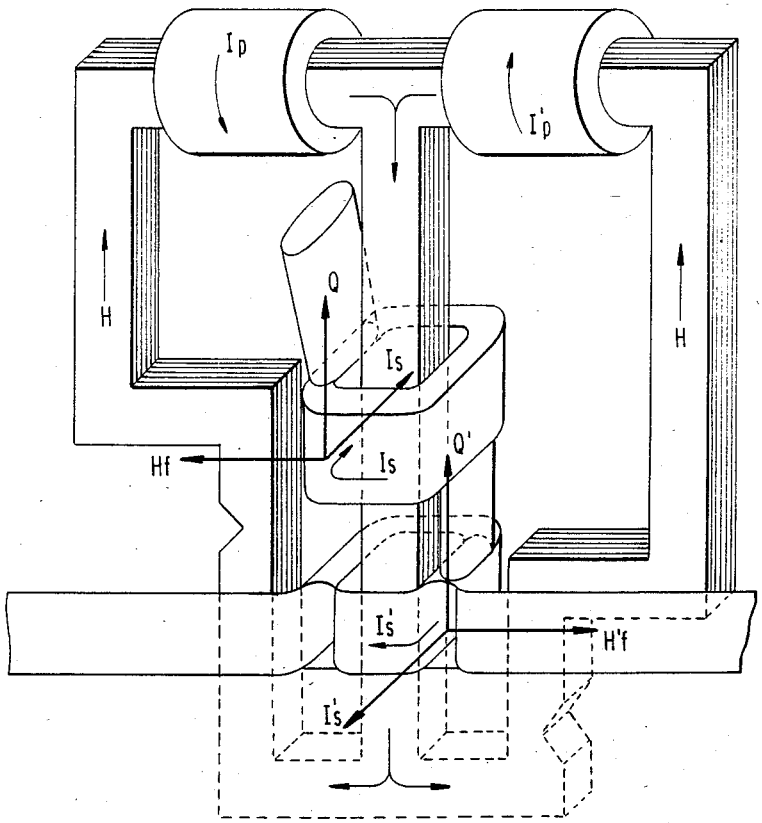

In another variant shown in FIG. 6, a transformer having three vertical magnetic legs has all three legs brought closer together near the bottom to create a pump having two superposed liquid turns connected series. The two Ampère's rule vector diagrams show that the pumping forces are cumulative.

Figure 7:
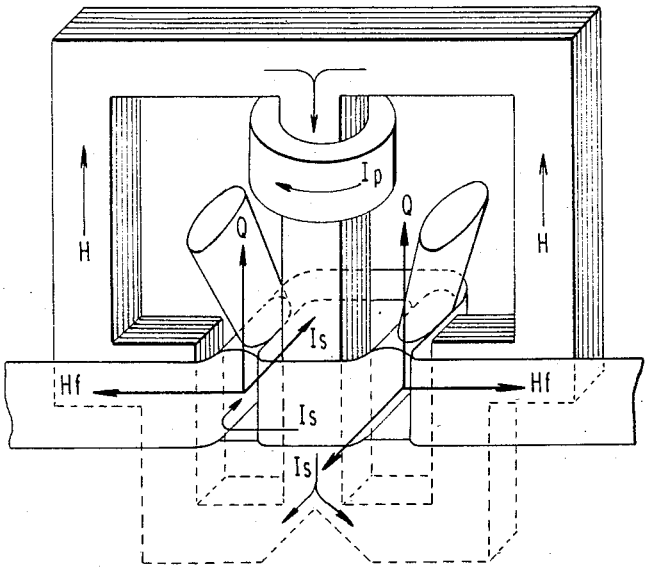

Similarly, another variant shown in FIG. 7 consists in using a three-legged transformer having its outer legs brought close to the middle leg to create a pump having parallel effects in a single liquid turn. Each half turn is active and urges metal upwardly. The two outlets may be independent or they may be connected to have a parallel flow-increasing effect. FIG. 7 also shows a single winding mounted on the middle leg.

Figure 8:
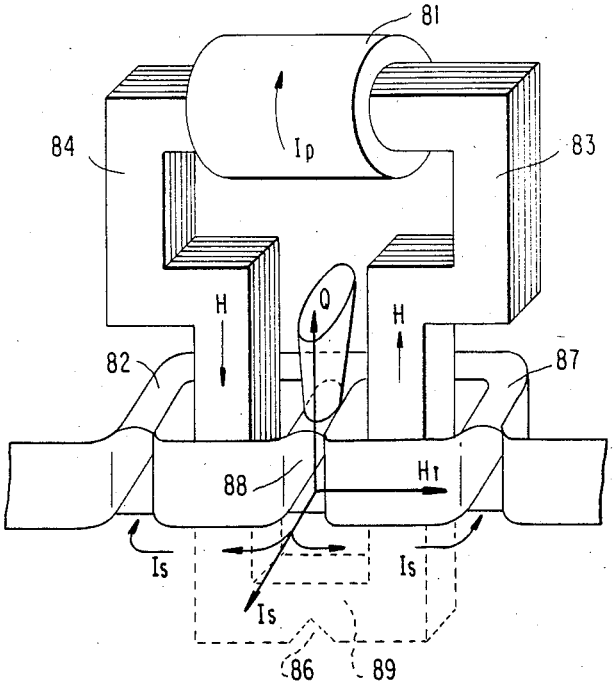

It is also possible in the same line of thinking to use a transformer having a single magnetic circuit as shown in FIG. 8. The transformer has a single excitation winding 81 and two vertical legs 83 and 84 together with two liquid turns 82 and 87 around respective vertical legs and sharing a common portion 88 extending between the two legs. The front face of the liquid turns 82, 87 and the common portion 88 are open to the main basin of the furnace to be supplied with liquid metal. The common portion 88 between the close together portions of the vertical legs 83 and 84 constitutes the active region of the electromagnetic pumping system. In this active region 88, the electric currents induced in the two liquid turns 82 and 87 are cumulative in intensity and in direction. The saturation notch 86 is placed in the middle of the horizontal bottom branch 89 and serves to increase the leakage field Hf. The Ampère's rule vector diagram shows that the resultant force is upwardly detected.

The saturation notch 86 could be replaced by more progressive necking in each of the closer together portions of the two vertical legs 83 and 84 or by any other one of the saturation-causing means mentioned above.

The particular means for obtaining local saturation described herein for obtaining electromagnetic pumping turns is not limiting in any way since other applications falling within the scope of the invention and obvious to the person skilled in the art could also be used, for example transformers having a plurality of legs with a plurality of turns using parallel and/or series effects spread over several stages.

In practice, the lateral basin of a furnace could be made with the electromagnetic pumping system shown in principle in FIG. 8 and embedded in the ceramic of the said lateral basin.

FIG. 9 is a view similar to FIG. 2, but shows only the portion of the furnace which includes the electromagnetic pumping system. The magnetic circuit 207 is partially embedded in the ceramic, as are the active turn 204 and the metal outlet duct 206. The excitation winding 208 is in ambient air. The active turn 204 is in communication with the bulk of the furnace 202 via a metal inlet orifice 205. The section of this figure only shows the active portion 204 and the front and rear portions of two turns connected to this active portion 204. These portions are higher than the bottom of the furnace and the partition 209 descends below the bottom level of the active turn in order to limit unwanted movements in the liquid metal between the active turn 204 and the furnace 202 via the inlet orifice 205.

FIG. 10 is a section XX' similar to FIG. 3 and shows the magnetic circuit 207 of the transformer together with its excitation winding 208. The active portion of the turn 204 is situated between the close portions of the vertical legs of the transformer 207. Saturation is obtained in this case by progressively narrowing the close portions of the vertical legs at around 210. The two turns 211 and 212 and their common portion 204 surround the close portions 210 of the vertical legs and are in communication with the furnace. The turns 211 and 212 rise from close to the bottom of the furnace at the inlet 205 up to the level of the active turn 204 which extends rearwardly, thereby enabling both liquid turns to be emptied.

The winding 208 is shown as being located above the furnace but it could equally well be placed on one side thereof, e.g. in front of the basin. In such a case the outlet duct 206 could be vertical immediately above the active portion of the turn 204 instead of sloping, which would then enable an outlet tube connected thereto to be pointed in any direction.

Without going beyond the scope of the invention, the winding 208 could be split in two to have two half-windings placed on each side of the furnace.

FIG. 11 is a horizontal section similar to FIG. 4 showing the magnetic circuit 207 of the transformer, the active portion of the liquid turn 204 together with the two turns 211 and 212 on either side thereof, the partition 209, and the outlet tube 206 which is shown in dashed lines since it is located above the section.

FIG. 12 is a side view similar to FIG. 9 but looking the other way. This figure shows a variant construction which consists in molding the electromagnetic pumping system at least in part such that a portion at least of the magnetic circuit 307 and of the liquid turn 304 are constituted in a block of ceramic 313 which is identical to or different from the ceramic lining of the basin. The lateral basin 315 is removable and the ceramic 324 of the lateral basin 315 is cast to have an inside shape suitable for receiving the outside shape of the ceramic block 313 which includes the electromagnetic pumping system. A flexible sheet of alumina felt or fiber is placed between the basin and the electromagnetic pumping system, thus facilitating dis-assembly and preventing possible leakages of liquid metal from spreading. Alumina felts are commercially available.

The fixed portion of the furnace 316 is fixed to a frame 317 capable of receiving the removable basin 315. The removal basin is assembled to the furnace by means of a conventional screw-and-nut 318 system (see FIG. 13) with each system including at least one spring for compressing an alumina felt or fiber gasket 319 which is placed between the removable basin 315 and the furnace 316.

FIG. 13 is a plan view of the furnace as assembled and shows that the furnace includes a removable ceramic crucible. The crucible is heated, for example, by electrical rods or by a metal coating deployed around the outside shape of the crucible or buried in the fibers or in the ceramic of the furnace.

FIG. 14 is an exploded view showing the various portions of the furnace when dis-assembled from one another.

The furnace shown is rectangular in shape, but naturally any other desired shape could be given to the furnace and electromagnetic pump system depending on requirements. In particular, the furnace could be cylindrical.

Similarly, a set of different electromagnetic basins or of different electromagnetic pumping systems for a given basin could readily be used without going beyond the scope of the invention which concerns having an electromagnetic pumping system integrated in a lateral basin.

Such pumping systems can be used in numerous ways in a foundry. They may be used in conjunction with low pressure or high pressure casting systems, with carrousel-type casting systems, with systems for casting under a vacuum, with lost wax casting systems, etc. Such pumps serve to avoid the need for gravity casting and enable metal to be cast into a mold which is at a higher level than the furnace. The pumps may also be used for transferring metal out from the furnace.

I claim:

1. In a lateral ceramic basin for a furnace, an electromagnetic pump inserted in the lateral ceramic wall of the lateral ceramic basin, comprising an electrical excitation winding disposed in ambient air for producing a primary current, a vertical magnetic circuit comprising two vertical branches, and a circular duct for molten metal, said duct carrying a secondary current induced therein by the transformer action of said magnetic circuit, said duct being positioned relative to said two vertical branches such that a horizontal magnetic leakage field H between the two vertical legs in combination with the secondary current produce a vertically upward force on the molten metal in said duct, wherein at least a part of said magnetic circuit and a portion of said circular duct for molten metal are located in the ceramic wall of said lateral basin.

2. In a lateral ceramic basin for a furnace, an electromagnetic pump inserted in the lateral ceramic wall of the lateral ceramic basin, comprising an electrical excitation winding disposed in ambient air for producing a primary current, a circular duct for molten metal partially located in said lateral ceramic wall, a vertical magnetic circuit comprising four branches, two vertical and two horizontal, partially located in said lateral ceramic wall, the portion of the magnetic circuit located in said ceramic wall having a reduced cross-section, said duct carrying a secondary current induced therein by the transformer action of said magnetic circuit, said duct being positioned relative to said magnetic circuit such that a horizontal magnetic leakage field H between vertical legs of said magnetic circuit in combination with the secondary current produces vertically upward force on the molten metal in said duct.

3. In the lateral ceramic basin for a furnace according to claim 2, wherein at least a portion of the circular duct for molten metal located in the ceramic of said lateral basin is passing between the vertical branches of the magnetic circuit and is located at the level at which said vertical branches are brought closer together relative to their separation than the rest of their vertical extent.

4. In the lateral ceramic basin for a furnace according to claim 3, wherein the cross-section of the vertical branches of the magnetic circuit are reduced at the level of the circular duct for molten metal passing between the vertical branches.

5. In the lateral ceramic basin for a furnace according to claim 4, in which the circular duct of the electromagnetic pump includes two outlet ducts for molten metal having a common central active position wherein said active position is placed between the vertical branches of the magnetic circuit and is located at the level at which said vertical branches are relatively close to each other and have a reduced cross-section.

6. In the lateral ceramic basin for a furnace according to claim 5, wherein at least said active portion of the circular duct and a portion of the active magnetic circuit are lodged into a premolded ceramic block which is itself removable from the furnace.

* * * * *